US010900311B2

(12) United States Patent
Xu et al.

(10) Patent No.: US 10,900,311 B2
(45) Date of Patent: Jan. 26, 2021

(54) OBJECT REMOVAL ENHANCEMENT ARRANGEMENT AND METHOD

(71) Applicants: YingQing Xu, Tomball, TX (US); Michael Johnson, Katy, TX (US); Matthew Stone, Humble, TX (US); Colin Andrew, Cypress, TX (US); Zhiyue Xu, Cypress, TX (US)

(72) Inventors: YingQing Xu, Tomball, TX (US); Michael Johnson, Katy, TX (US); Matthew Stone, Humble, TX (US); Colin Andrew, Cypress, TX (US); Zhiyue Xu, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 36 days.

(21) Appl. No.: 16/046,823

(22) Filed: Jul. 26, 2018

(65) Prior Publication Data

US 2020/0032605 A1 Jan. 30, 2020

(51) Int. Cl.

| | |
|---|---|
| ***E21B 29/02*** | (2006.01) |
| ***E21B 43/26*** | (2006.01) |
| ***E21B 33/12*** | (2006.01) |
| ***E21B 1/02*** | (2006.01) |

(52) U.S. Cl.
CPC ..... *E21B 29/02* (2013.01); *E21B 43/26* (2013.01)

(58) Field of Classification Search
CPC ..... E21B 29/02; E21B 43/26; E21B 33/12; E21B 34/06; B22F 1/02
See application file for complete search history.

(56) References Cited

U.S. PATENT DOCUMENTS

| | | | | |
|---|---|---|---|---|
| 8,573,295 | B2 | 11/2013 | Johnson et al. | |
| 9,079,246 | B2 | 7/2015 | Xu et al. | |
| 9,938,451 | B2 * | 4/2018 | Crews | C09K 8/52 |
| 2013/0043041 | A1 | 2/2013 | McCoy et al. | |
| 2013/0146302 | A1 | 6/2013 | Gaudette et al. | |

(Continued)

FOREIGN PATENT DOCUMENTS

WO 2015073001 A1 5/2015

OTHER PUBLICATIONS

Notification of Transmittal of the International Search Report and the Written Opinion of the International Searching Authority, or the Declaration; PCT/US2019/038381; dated Sep, 30, 2019; ISR 4 pages, WO 7 pages; Total 11 pages.

*Primary Examiner* — Tara Schimpf
*Assistant Examiner* — Manuel C Portocarrero
(74) *Attorney, Agent, or Firm* — Cantor Colburn LLP

(57) ABSTRACT

An object removal enhancement arrangement including a second object comprising a material configured to enhance degradation of a first object. A resource recovery system including a tubular string disposed in a formation, a first seat disposed in the tubular string, a second seat disposed in the tubular string, an object receivable in the second seat upstream of the first seat, the object comprising a material to enhance degradation of an object receivable in the first seat. A method for enhancing response time for degrading degradable objects in a system including landing a first object on a first seat, pressuring against the first object, landing a second object on a second seat uphole of the first object, releasing a material of the second object to an environment between the first seat and the second seat.

13 Claims, 2 Drawing Sheets

(56) References Cited

U.S. PATENT DOCUMENTS

| | | | | |
|---|---|---|---|---|
| 2013/0192829 | A1* | 8/2013 | Fadul | E21B 43/11 166/297 |
| 2014/0076571 | A1* | 3/2014 | Frazier | E21B 43/26 166/308.1 |
| 2015/0159462 | A1 | 6/2015 | Cutler | |
| 2016/0273300 | A1 | 9/2016 | Walton et al. | |
| 2016/0312111 | A1 | 10/2016 | Okura et al. | |
| 2017/0121596 | A1* | 5/2017 | Canova | E21B 43/26 |
| 2018/0087369 | A1* | 3/2018 | Sherman | E21B 29/00 |
| 2020/0032606 | A1 | 1/2020 | Xu et al. | |

* cited by examiner

OBJECT REMOVAL ENHANCEMENT ARRANGEMENT AND METHOD

BACKGROUND

In the resource recovery industry it is often the case that multiple tools are positioned in the downhole environment that are actuated by objects landed on seats to facilitate the imposition of pressure differentials across such seats to make components of the downhole system move. In many such systems of a more contemporary nature, the objects are degradable objects such as for example, objects made from IN-Tallic™ degradable material commercially available from Baker Hughes, a GE company, Houston Tex. One example of a system like this is a fracture and production system where a fracturing operation is undertaken by landing an object on a fracture seat and pressuring up thereon to fracture a zone of the formation. Another object may then be landed on a second seat to close fracture ports and open production ports. Other systems like this example are certainly available in the art. In each of these, circulating fluid does not well reach the first landed object as it is in a relatively dead fluid and debris collecting space of the borehole between the second landed object and the seat upon which the first landed object is seated. The condition just discussed tends to result in a reduced reactivity such that degradable objects fail to degrade at the rate at which they were designed to degrade thereby inducing delay in whatever operation is being performed. The art would well receive arrangements that improve efficiency.

SUMMARY

An object removal enhancement arrangement including a second object comprising a material configured to enhance degradation of a first object.

A resource recovery system including a tubular string disposed in a formation, a first seat disposed in the tubular string, a second seat disposed in the tubular string, an object receivable in the second seat upstream of the first seat, the object comprising a material to enhance degradation of an object receivable in the first seat.

A method for enhancing response time for degrading degradable objects in a system including landing a first object on a first seat, pressuring against the first object, landing a second object on a second seat uphole of the first object, releasing a material of the second object to an environment between the first seat and the second seat.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
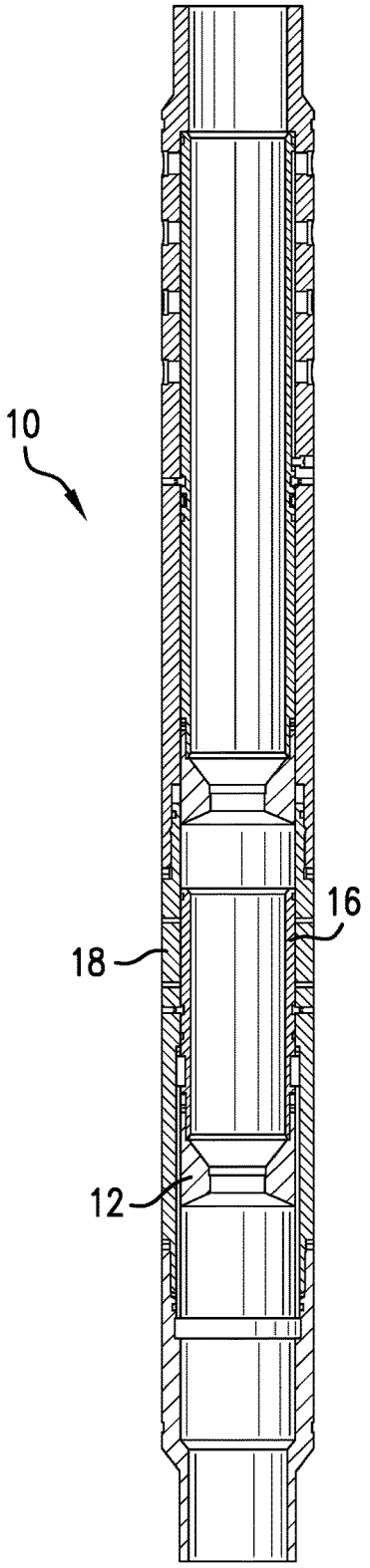
FIGS. 1 and 2 illustrate an exemplary fracture and production system, FIG. 1 being in a position prior to objects being landed and FIG. 2 being in a position after both objects have been landed.
Figure 2:
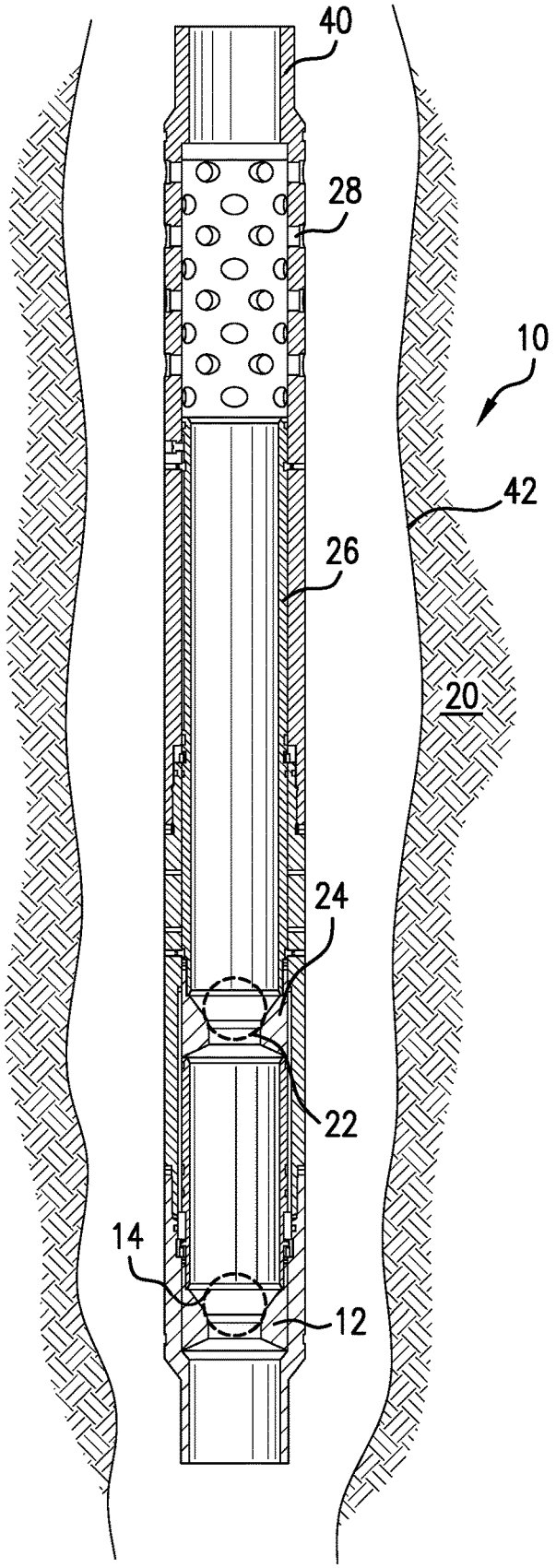
Figure 3:
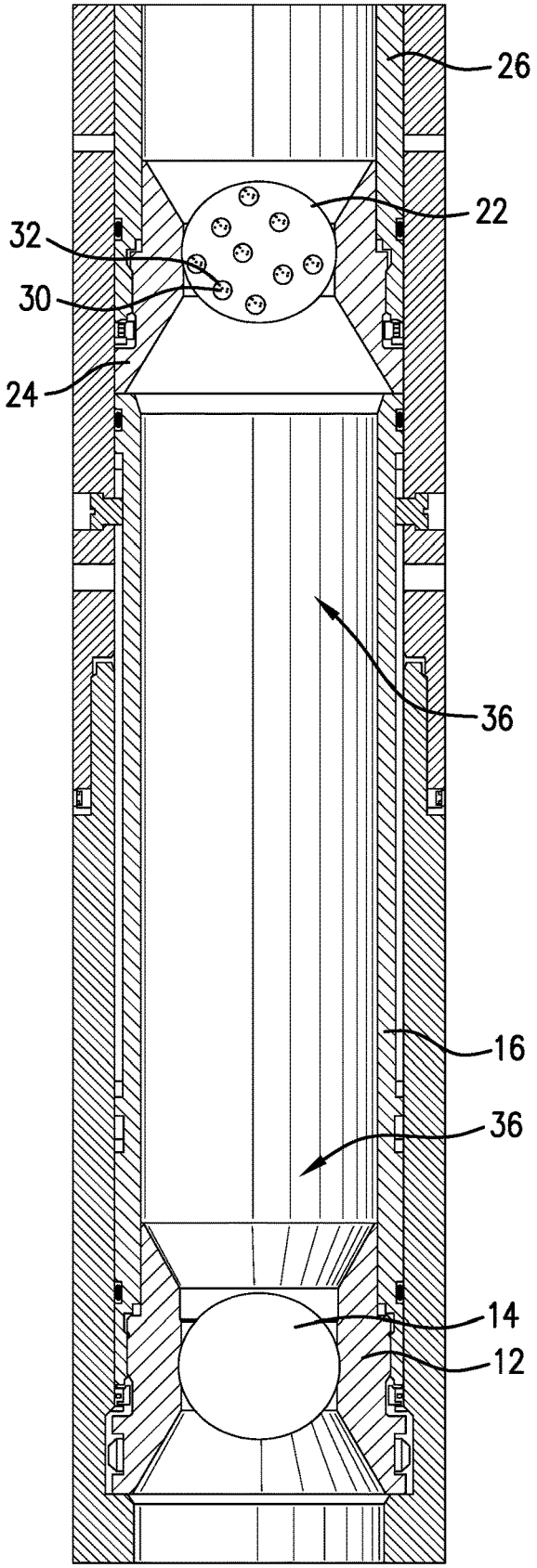
FIG. 3 is an enlarged view of a portion of FIG. 2 including the objects.

Referring to FIGS. 1, 2 and 3 together, an exemplary fracture and production system 10 is illustrated in two positions. The first position, shown in FIG. 1, the system 10 is ready for use before any objects are landed therein. During use, a lower seat 12 is employed to catch an object 14 (seen in FIG. 2). Object 14 is intended to hold great pressure related to fracturing a zone of the formation. Because of this, the object itself must have the structural integrity to withstand the forces placed thereon. Greater structural integrity is the antithesis of degradatory components and hence these particular objects present greater difficulty with respect to rapid degradation. Once object 14 is seated in seat 12, pressure may be applied thereto moving seat 12 in a direction to move a sleeve 16, which may be a frac sleeve, to uncover a port 18, which may be a frac port. It will be appreciated that FIGS. 1 and 2 do not show the intermediate position of the frac port 18 open for a fracturing operation but rather jump from the first position where neither of the seats are moved to a production position where both of the seats are moved. The sequence of a first object opening a fracture port and a second object closing the fracture port and opening a production pathway is a known sequence and hence does not require ad nauseum recitation. The object removal enhancement arrangement and method disclosed herein on the other hand is an advancement for the art. To ensure understanding of the object removal enhancement arrangement and method this basic reference to the system is useful. Once the frac port 18 is uncovered by movement of sleeve 16, a pressure up operation against the object 14 will result in fracturing of a formation 20 radially outwardly of the system 10. Once the fracturing is complete, a second object 22 is landed upon an upper seat 24. This allows for pressure differential across seat 24 and thereby movement of seat 24 in the downhole direction. The seat 24 is connected to a closure sleeve 26 that is drawn along in the downhole direction with the seat 24 thereby closing the port 18 and opening a production pathway 28. Each of the objects 14 and 22 comprise a degradable material and will eventually degrade but such degradation may be enhanced by the modification of object 22. It should be understood that object 22 merely needs to support a pressure differential thereacross sufficient to move sleeve 26. It does not need to hold the same differential pressure as object 14. Specifically, the required pressure differential to fracture formation 20 is many times higher than the pressure differential needed to move a sleeve within a wellbore tool in most cases, including those contemplated here. Because of the reduced structural requirements for object 22, the inventors hereof have created an object 22 that upon beginning its own degradation, will emit a material 30 capable of enhancing the degradation of object 14. The material 30 may be a reagent and may be placed within one or more recesses or cavities 32 in the object 22 or may be mixed with whatever base material of which the object is made. In either case, the material 30 will be released from the object 22 as that object begins to degrade and will migrate into environment 36 and thence to object 14, enhancing the degradation thereof and thereby rendering the system ready for production more quickly than prior art systems become ready based solely upon the degradatory makeup of the objects 14, 22 themselves.

Reagents contemplated for the material 30 include: inorganic salts, organic or inorganic acids, organic or inorganic bases. Exemplary materials include sodium chloride, dissolvable silicates, calcium oxide, adipic acid, succinic acid, polylactic acid, polyglycolic acid, or a combination comprising at least one of the foregoing. The material 30 may be in solid (powder, particulate, etc.) or liquid form providing the cavity or recess 32 is fluid sealed such that a liquid may be contained. It is further contemplated that material 30 may comprise both liquid and solid components thereof. These may be different phases of the same chemical structure or may be different chemical structures whether actually mixed or simply commingled.

The system 10 is contemplated to be employed as a part of a tubular string 40 disposed within the formation 20 through a borehole in the formation 20.

A method for enhancing response time for degrading degradable objects in a system 10 including releasing a material 30 to an environment 36 between a first object 14 and a second object 22 and degrading the object 14 and/or seat 12.

Set forth below are some embodiments of the foregoing disclosure:

Embodiment 1: An object removal enhancement arrangement including a second object comprising a material configured to enhance degradation of a first object.

Embodiment 2: The arrangement as in any prior embodiment wherein the second object comprises a base substance mixed with the material.

Embodiment 3: The arrangement as in any prior embodiment wherein the second object includes a recess or cavity.

Embodiment 4: The arrangement as in any prior embodiment wherein the recess or cavity contains the material.

Embodiment 5: The arrangement as in any prior embodiment wherein the material is a solid.

Embodiment 6: The arrangement as in any prior embodiment wherein the material is a liquid.

Embodiment 7: The arrangement as in any prior embodiment wherein the material comprises both liquid and solid components.

Embodiment 8: The arrangement as in any prior embodiment wherein the material is an acid.

Embodiment 9: The arrangement as in any prior embodiment wherein the material is an inorganic salt; an organic or inorganic acid; an organic or inorganic base or combinations including at least one of the foregoing.

Embodiment 10: The arrangement as in any prior embodiment wherein the material is sodium chloride, dissolvable silicates, calcium oxide, adipic acid, succinic acid, polylactic acid, polyglycolic acid, or a combination comprising at least one of the foregoing.

Embodiment 11: A resource recovery system including a tubular string disposed in a formation, a first seat disposed in the tubular string, a second seat disposed in the tubular string, an object receivable in the second seat upstream of the first seat, the object comprising a material to enhance degradation of an object receivable in the first seat.

Embodiment 12: A method for enhancing response time for degrading degradable objects in a system including landing a first object on a first seat, pressuring against the first object, landing a second object on a second seat uphole of the first object, releasing a material of the second object to an environment between the first seat and the second seat.

Embodiment 13: The method as in any prior embodiment wherein the pressuring against the first object includes fracturing a formation.

Embodiment 14: The method as in any prior embodiment wherein the releasing includes degrading the second object.

Embodiment 15: The method as in any prior embodiment wherein the method includes migrating the material to the first object.

Embodiment 16: The method as in any prior embodiment wherein the method includes degrading the first object.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for enhancing response time for degrading degradable objects in a system comprising:

landing a first object on a first seat;

pressuring against the first object;

landing a second object on a second seat uphole of the first object;

releasing a material of the second object to an environment between the first seat and the second seat; and migrating the material to the first object.

2. The method as claimed in claim 1 wherein the pressuring against the first object includes fracturing a formation.

3. The method as claimed in claim 1 wherein the releasing includes degrading the second object.

4. The method as claimed in claim 1 wherein the method includes degrading the first object.

5. The method as claimed in claim 1 wherein the second object comprises a mixture of a base substance and the material.

6. The method as claimed in claim 1 wherein the releasing is opening a cavity in the second object, the cavity containing the material.

7. The method as claimed in claim 1 wherein the material is a liquid.

8. The method as claimed in claim 1 wherein the material is a solid.

9. The method as claimed in claim 1 wherein the material comprises both solid and liquid components.

10. The method as claimed in claim 1 wherein the material is an acid.

11. The method as claimed in claim 1 wherein the material is an inorganic salt; an organic or inorganic acid; an organic or inorganic base or combinations including at least one of the foregoing.

12. The method as claimed in claim 1 wherein the material is a sodium chloride, dissolvable silicates, calcium oxide, adipic acid, succinic acid, polylactic acid, polyglycolic acid, or a combination comprising at least one of the foregoing.

13. The method as claimed in claim 1 wherein the system is a resource recovery system.

* * * * *